United States Patent [19]

Bradt et al.

[11] Patent Number: 4,700,166

[45] Date of Patent: Oct. 13, 1987

[54] CURRENT TRANSFORMER HAVING A RECTANGULAR IRON CORE

[75] Inventors: Peter Bradt, Ganderkesse; Günter Prietzel, Berlin, both of Fed. Rep. of Germany

[73] Assignee: Siemens Aktiengesellschaft, Munich, Fed. Rep. of Germany

[21] Appl. No.: 836,393

[22] Filed: Mar. 5, 1986

[30] Foreign Application Priority Data

Mar. 6, 1985 [DE] Fed. Rep. of Germany ..... 3508327

[51] Int. Cl.[4] ..... H01F 27/30; H01F 40/06

[52] U.S. Cl. ..... 336/175; 29/606; 336/65; 336/192; 336/198

[58] Field of Search ..... 336/192, 198, 208, 174, 336/175, 176, 65; 363/126; 29/605, 606

[56] References Cited

U.S. PATENT DOCUMENTS

| | | | |
|---|---|---|---|
| 2,544,658 | 3/1951 | D'Entremont . | |
| 2,880,401 | 3/1959 | Mercier | 336/96 |
| 3,243,746 | 3/1966 | Doggart et al. | 336/198 X |
| 4,238,753 | 12/1980 | Bayer | 336/178 |

FOREIGN PATENT DOCUMENTS

| | | | |
|---|---|---|---|
| 731536 | 2/1943 | Fed. Rep. of Germany | 336/208 |
| 1117213 | 11/1961 | Fed. Rep. of Germany . | |
| 2006736 | 8/1971 | Fed. Rep. of Germany . | |
| 2233005 | 5/1973 | Fed. Rep. of Germany . | |
| 157738 | 1/1979 | Netherlands | 336/198 |
| 804827 | 11/1958 | United Kingdom | 336/208 |
| 808030 | 1/1959 | United Kingdom . | |
| 1339151 | 11/1973 | United Kingdom . | |
| 1545645 | 5/1979 | United Kingdom | 363/126 |
| 2054973 | 2/1981 | United Kingdom | 336/198 |

OTHER PUBLICATIONS

Mitsubishi Electric 0482/AE-SG.

*Primary Examiner*—Thomas J. Kozma
*Attorney, Agent, or Firm*—Kenyon & Kenyon

[57] ABSTRACT

A current transformer comprises coil forms mounted on two opposite legs of a rectangular iron core, and insulating parts for insulating the iron core from a current bar which can be brought through the interior of the current transformer. The coil forms are connected together at both ends by an insulating part which surrounds at least partially the exposed legs of the iron core in U-fashion. For manufacturing a current transformer, the coil forms are first connected by assembling the insulating parts to the coil forms to form a frame into which L-shaped laminations are inserted to form the iron core. These laminations are connected at the abutting gaps by a welded seam. The current transformer is suitable particularly for use in low-voltage circuit breakers.

6 Claims, 3 Drawing Figures

CURRENT TRANSFORMER HAVING A RECTANGULAR IRON CORE

BACKGROUND OF THE INVENTION

The present invention relates to a current transformer having a rectangular iron core, especially for low-voltage circuit breakers, with coil forms mounted on opposite legs of the iron core, having terminal devices for windings located on the coil forms, and insulating parts for insulating the iron core from a bus bar to be enclosed by the iron core.

Current transformers of this type are known, for instance, from the company publication "Mitsubishi Electric 04 82/AE-S/G" and serve, when applied to low-voltage circuit breakers, to obtain from the currents flowing through the main coil paths, small currents suitable for feeding electromechanical or electronic tripping devices. In principle, the current transformers are designed as transformers, of which the primary winding is a current-carrying bar as part of the current path of the circuit breaker. Since as a rule one current transformer is needed for each phase, and low-voltage circuit breakers, inserts for motor control and similar applications are produced in relatively large quantities, there is an interest in a design of such a current transformer which makes possible inexpensive production.

SUMMARY OF THE INVENTION

In this context, it is therefore an object of the invention to ensure an effective and long-lasting insulation between the primary part and the secondary part of the current transformer which is simple to produce.

In a current transformer of the type mentioned above, the above and other objects are achieved by the provision that the coil forms are connected at both ends by an insulating part and that the insulating part surrounds the exposed legs of the iron core at least partially in U-fashion. The insulating parts cover the sides of the iron core facing the current-carrying bar. At the same time, the insulating parts form a mechanical connection of the two coil forms. This makes it possible to first complete the coils to form a self-supporting frame and to make the necessary wiring connections before the iron core is assembled. This substantially facilitates the handling of the parts during the manufacturing process of the current transformers.

The mentioned insulating parts can further be designed so that they extend at least partially around the current-carrying bar in U-fashion over the width of the current transformer. In this manner, an extension of the leakage paths between the current-carrying bar and the windings or their terminals is achieved also in the space between the coil forms. Through this design, the insulating parts are given approximately the shape of two U-profiles which cross each other at right angles and are open in opposite directions.

It is advisable to provide the coil forms with terminal chambers for the winding leads, these terminal chambers forming contact surfaces for the region of each insulating part extending around the current bar. This design facilitates the assembly of the coil forms and the insulating parts.

The terminal chambers can further be designed open on only one side; the connecting pieces surrounded by them can be arranged set back from the opening of the terminal chambers. This turns out to be advantageous in connection with a method for manufacturing a current transformer, as will be explained further on.

An advantageously simple way of assembling the coil forms and the insulating parts connecting them can be achieved by designing the coil forms and the insulating parts so that they cooperate in a form-locking manner. In this connection it is advisable to design the insulating body so that its region extending around the iron core in U-fashion engages fitting terminal regions of the coil forms at both ends with overlap. This has an equally beneficial effect on the mechanical stability of the mentioned frame-like structure as well as on the increase of the leakage paths.

For this purpose, mutually correlated depressions and projections can be provided at the coil forms and the insulating parts which form a snap-in connection with a form-locking effect. In this manner, the coil forms and the insulating parts can be assembled only by a brief application of force to form a closed frame without the aid of tools or special connecting elements.

The insulating bodies can have a rib for forming a wiring channel in an arrangement parallel to a wall part covering the iron core laterally. In this wiring channel, connecting lines of the windings on the coil forms can be installed with good mechanical protection, whereby also the leakage paths are increased.

An advantageous method for manufacturing a current transformer of the type described above may provide that, after placing the windings on the coil forms, the latter are connected by attaching the insulating parts to form a frame and that L-shaped laminations are inserted for forming the iron core; and that subsequently the stacks of laminations are connected at the outer edges of the gaps by an arc weld. By the welded seam, the lamination stacks are firmly connected to each other, although it can be executed as a melt with small depth of penetration. The magnetic properties of the iron core are therefore maintained independently of later influences in operation such as vibrations, temperature changes and the like. At the same time, the iron core now forms a clamp which holds the coil forms together.

BRIEF DESCRIPTION OF THE DRAWINGS

The invention will be explained in greater in the following detailed description with reference to the drawings in which.

DETAILED DESCRIPTION

Figure 1:
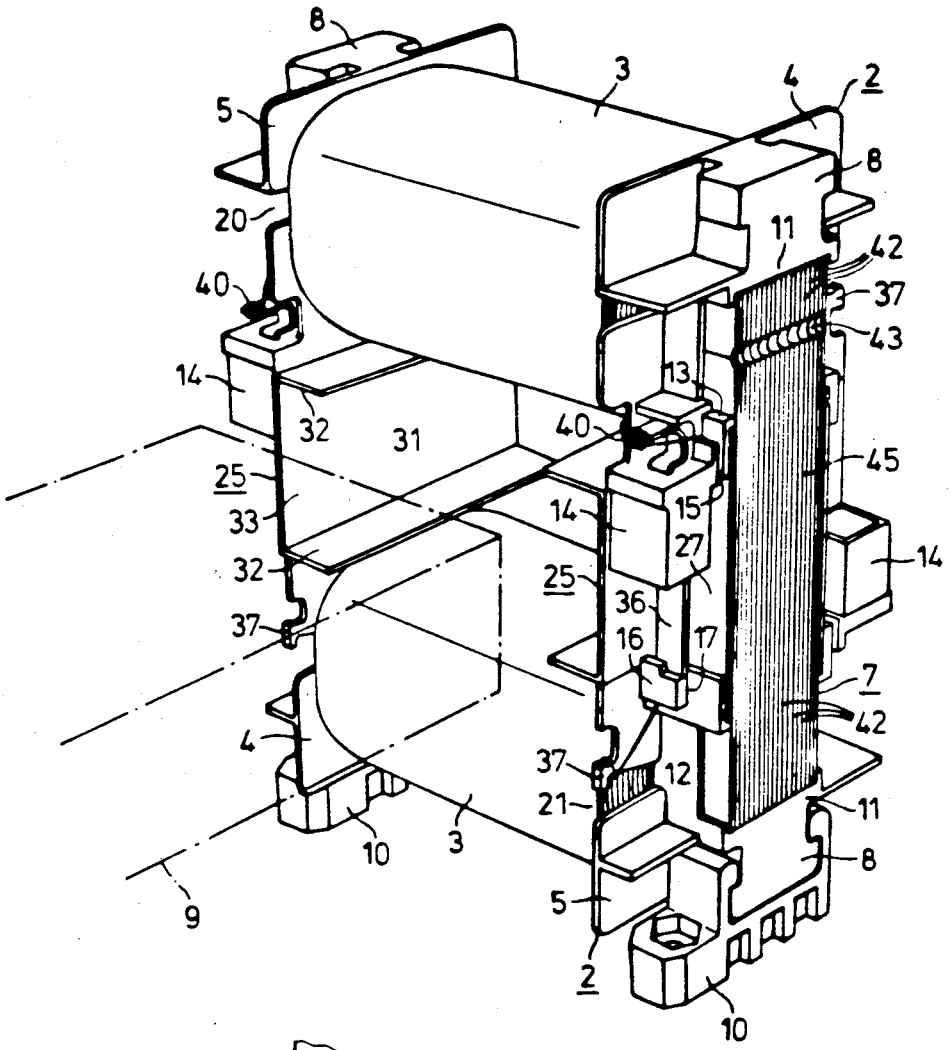
FIG. 1 shows a current transformer in a perspective view.

With reference now to the drawings, the current transformer 1 according to FIG. 1 comprises two identical coil forms 2 with windings 3 located thereon. Each of the coil forms 2 has, in the usual manner, winding flanges 4 and 5 for defining the winding space, and furthermore, a rectangular hollow winding core 6 (see FIG. 2) for accepting one leg each of a rectangular iron core 7. As can be seen particularly from FIG. 2, the coil forms 2 are uniform bodies which can be made preferably by injection-molding a suitable plastic. At the flanges 4 and 5 of the coil forms 2, elements are formed which are essential for the efficient manufacture of the current transformer 1. In particular, each of the flanges 4 and 5 carries an approximately mushroom-shaped extension 8 which serves for receiving a base part 10 which is shown in FIG. 1 and the use of which will be described later. The flanges 4 and 5 are furthermore provided with wall parts which extend in the extension of the winding core 6. The wall parts cover the iron core in this region partially. The one wall part 11 is part of the extension 8 and has the height of the iron core 7, while the lateral wall parts 12 and 13 have a somewhat smaller height locally than the wall part 11 for a purpose yet to be explained.

At the flanges 4 and 5 are further formed terminal chambers 14 for receiving a contact pin, a screw terminal or the like. Between the terminal chambers 14 and the wall part 13, there is a slot 15 which is provided for the protected insulation of a winding wire or a line, as will be explained further on. Logically the same design is present on the opposite side in the vicinity of the wall part 12 where a slot 17 is likewise formed by a lower wall part 16 which is arranged parallel to wall part 12. In addition, the flanges 4 and 5 are provided in the region of the terminal chamber as well as of the slot 17 with recesses 20 and 21 which serve for conveniently inserting and bringing out the winding wires from the winding space.

As will be seen, the distance 22 of the wall parts 12 and 13 on their side opposite the extension 8 is enlarged by a step to a greater distance 23. Similarly, the flanges 4 and 5 are designed in this region with reduced wall thickness to create a depression. Thereby, terminal regions 24 are provided for the engagement of insulating parts 25, where the mentioned increase of the dimension and the reduction of the wall thickness of a U-shaped region 26 are provided for surrounding the exposed leg 45 of the iron core 7. The region 26 is formed by side walls 27 having the height of the iron core 7 as well as by a bottom part 28 having the width of the iron core 7. Near their ends, the side walls 27 and the bottom part 28 are provided on the outside with a groove 29 which cooperates with suitably formed projections 30 of the wall parts 12 and 13 in the terminal region 24 in a form-locking manner, i.e., a snap-in connection.

Perpendicularly to the U-shaped region 26 of the insulating part 25 formed by the side walls 27 and the bottom part 28, extends a further U-shaped region 31 with wall parts 32 and a bottom part 33 which is open toward the opposite side. The length of this region is designed corresponding to the total width of the current transformer 1 (FIG. 1) and accordingly extends over the width of the flanges 4 and 5. The U-shaped region 31 serves for lengthening the leakage path between a rectangular bar 9 indicated in FIG. 1 and the windings 3 as well as the terminal devices of the winding ends. The ends of the U-shaped region 31 which extend over the U-shaped region 26 of the insulating part 25 act at the same time as abutments at the coil forms 2 when assembling these coil forms and the insulating parts 25. The undersides 34 of the terminal chambers 14 and an extension 35 formed in the extension of each wall part 16 serve as countersurfaces at the coil forms 2 for this purpose.

Parallel to the side walls 27 of the insulating part 25, straps 36 are provided which extend in the extension of the described conductor channels at the flanges 4 and 5, and serve for receiving the coil wires or leads.

The insulating parts 25 can likewise be realized as injection molded plastic parts. Their wall thickness can be chosen smaller than the wall thickness of the coil forms 2, since it is an important feature to maintain the length of electrical leakage paths and appreciable mechanical stresses do not occur.

Figure 2:
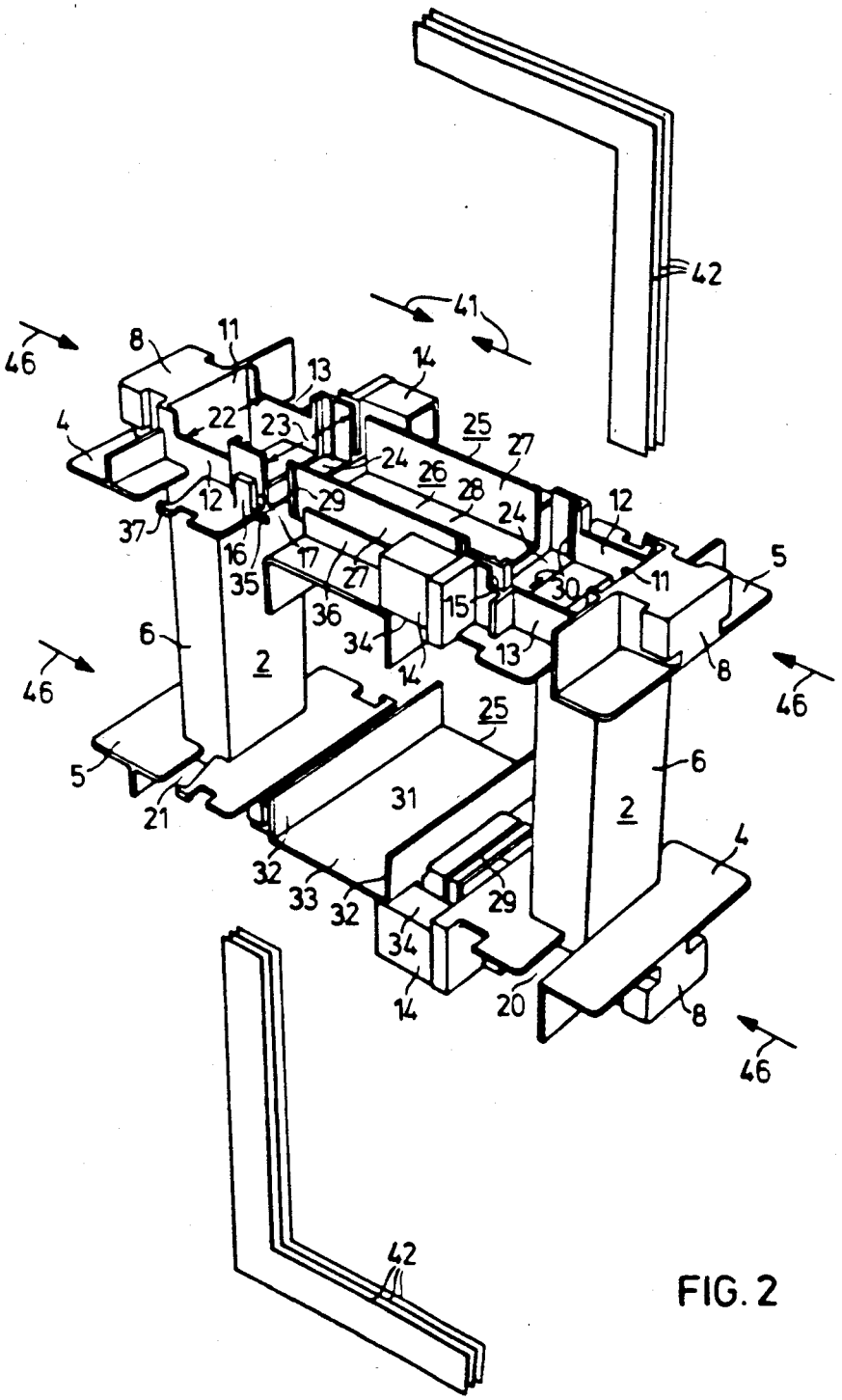
FIG. 2 shows two coil forms and insulating parts connecting them likewise in a perspective exploded view in a presentation rotated relative to FIG. 1.

For manufacturing the current transformer 1 shown in FIG. 1, windings are first placed on the coil form 2 in the manner known per se. Depending on the intended connection of the two windings, the winding ends are secured only mechanically to posts 37 of the flanges 4 and 5, or are concurrently soldered to the contact pieces 40 extending into the terminal chambers 14. Subsequently, both coil forms with the windings located thereon are connected by means of the insulating pieces 25, which can be accomplished, due to the snap-in connection provided, simply by exerting force for a short moment in the direction of the arrows 41 in FIG. 2. The assembly of the iron core 7 into the frame formed in this manner is then accomplished by introducing L-shaped iron laminations 42 from opposite sides without overlap as is indicated in FIG. 2. The closed magnetic circuit is produced by connecting the two L-shaped lamination stacks by an arc welding seam 43 at their abutment gaps. The wall parts 12 and 13 on the outsides of the flanges 4 and 5 are made for this purpose locally with a height smaller than the height of the iron core 7 so that the welding operation can be executed without damage to the plastic parts.

For the welding operation it is sufficient to melt the laminations down to a small depth without adding welding material. Advantageously, the lamination stacks are exposed to pressure in the direction of the arrows 46 (FIG. 2) where the forces can be introduced via the extensions 8. Thus, practically no air gap is produced at the abuting gaps of the laminations 42. Since also no transverse forms for clamping bolts, external clamps or rivets are required, the iron core 7 has good magnetic properties throughout with a comparatively small cross section.

The desired kind of coil connection can be made before or after the iron core is installed by, for instance, bringing the winding ends of the one winding through the mentioned wiring channels and soldering them to the leads 40 located at the other coil form.

If desired, the mechanically and electrically completed current transformer 1 can further be subjected to a varnishing treatment in order to improve the insulation and to protect the iron core 7 against corrosion. As can be seen from the description above, the manufacture of the current transformer 1 is substantially facilitated by the provision that the coil forms can be assembled by means of the insulating parts 25 prior to the installation of the iron core to form a stable frame accurate as to dimensions. The insulating parts 25 further ensure long-lasting insulation of the iron core 7 from the current-carrying bar 9 and the terminal devices of the winding ends. Because the coil forms 2 are identical, there is considerable freedom with respect to the location of the terminal points since a total of four terminal chambers 14 is available which are distributed on both sides of the current transformer 1. Similarly, the current transformer can be mounted as desired in the one position or a position rotated 90° because of the presence of four extensions 8. To this end, the base parts 10 can be slipped onto the corresponding extensions 8.

Figure 3:
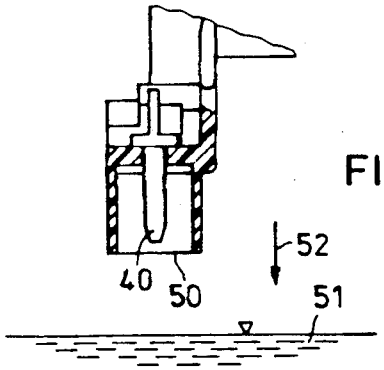
FIG. 3 shows a terminal chamber in cross section with an inserted terminal piece as a detail of a coil form, the surface of an impregnating bath being indicated.

In carrying out the mentioned varnish treatment, it is achieved by the special design of terminal chambers 14 and the arrangement of the connecting pieces 40 that the terminal pieces 40 are not wetted by the impregnating varnish and thus, subsequent cleaning of the terminal pieces is not necessary. In this connection, FIG. 3 shows by the example of one of the terminal chambers 14 that the corresponding connecting piece 40 is arranged set back from the opening 50. If now the completed current transformer 1 (FIG. 1) is introduced into the impregnating bath in the direction of the arrow 52, the opening 30 of the terminal chamber 14 equipped with the terminal pieces 40 faces the surface 51 of the impregnating bath. The terminal chambers thus act as diver's bells because they are made open only on one side. This prevents wetting of the connecting pieces by the impregnating medium.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarding in an illustrative rather than a restrictive sense.

What is claimed is:

1. A current transformer comprising a rectangular iron core, particularly for low-voltage circuit breakers, a coil form mounted on each of two opposite legs of the iron core, terminal means for each winding means disposed on each coil form, means for insulating the iron core from a current-carrying bar which is to be surrounded by the iron core comprising two insulating parts, each of the coil forms having respective ends connected together by respective ones of said insulating parts, the insulating parts each extending around respective ones of the remaining two exposed legs of the iron core at least partially in U-fashion, said insulating parts further being adapted to extend around the current-carrying bar at least partially over the width of the current transformer in U-fashion, said coil forms and said insulating parts interacting in form-locking fashion, each insulating part at ends thereof engaging in overlapping fashion with terminal regions of the coil forms.

2. The current transformer recited in claim 1, wherein the coil forms are each provided with terminal chambers for the winding terminal means, said terminal chambers forming contact surfaces for said U-shaped insulating parts adapted to extend around the current-carrying bar.

3. The current transformer recited in claim 2, wherein the terminal chambers are designed open on only one side and the terminal means disposed in the terminal chambers are arranged set back from the opening of the terminal chambers.

4. The current transformer recited in claim 2, wherein the ends of each insulating part and the terminal regions of the coil forms form a snap-in connection having form-locking action, said snap-in connection comprising mutually interacting depression and projection means.

5. The current transformer recited in claim 1, wherein the insulating parts comprise a first wall laterally covering the iron core and further comprising a further wall disposed parallel to the first wall for forming a channel for wires from the winding means.

6. The current transformer recited in claim 1, wherein the iron core is assembled from L-shaped butt-jointed metal sheets, said two L-shaped legs of the iron core being connected to the joints thereof by a welding seam.

* * * * *